US011757202B2

(12) United States Patent
Feng et al.

(10) Patent No.: US 11,757,202 B2
(45) Date of Patent: Sep. 12, 2023

(54) PILLAR-SHAPED LUNEBERG LENS ANTENNA AND PILLAR-SHAPED LUNEBERG LENS ANTENNA ARRAY

(71) Applicant: Huawei Technologies Co., Ltd., Shenzhen (CN)

(72) Inventors: Xin Feng, Chengdu (CN); Keli Zou, Chengdu (CN); Guolong Huang, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 314 days.

(21) Appl. No.: 17/334,346

(22) Filed: May 28, 2021

(65) Prior Publication Data

US 2021/0359421 A1 Nov. 18, 2021

Related U.S. Application Data

(63) Continuation of application No. PCT/CN2019/121921, filed on Nov. 29, 2019.

(30) Foreign Application Priority Data

Nov. 30, 2018 (CN) ..... 201811459192.7

(51) Int. Cl.
*H01Q 19/06* (2006.01)
*H01Q 15/08* (2006.01)
*H01Q 21/29* (2006.01)

(52) U.S. Cl.
CPC ..... *H01Q 19/06* (2013.01); *H01Q 15/08* (2013.01); *H01Q 21/293* (2013.01)

(58) Field of Classification Search
CPC ..... H01Q 15/08; H01Q 19/06; H01Q 21/293
See application file for complete search history.

(56) References Cited

U.S. PATENT DOCUMENTS 3,307,196 A * 2/1967 Horst ..... H01Q 15/08 343/911 R
4,361,841 A * 11/1982 Cassel ..... H01Q 15/08 343/754

(Continued)

FOREIGN PATENT DOCUMENTS

CN 101872902 A 10/2010
CN 102110893 A 6/2011

(Continued)

OTHER PUBLICATIONS

Yao et al., "A Low-Profile Aperture Impedance Matching Technique for TEM Planar Luneberg Lens," 2015 IEEE MTT-S International Microwave Workshop Series on Advanced Materials and Processes for RF and THzApplications (IMWS-AMP), total 3 pages (2015).

(Continued)

*Primary Examiner* — Graham P Smith
*Assistant Examiner* — Amal Patel
(74) *Attorney, Agent, or Firm* — Leydig, Voit & Mayer, Ltd.

(57) ABSTRACT

Embodiments of this application provide a pillar-shaped luneberg lens antenna and a pillar-shaped luneberg lens antenna array, and relate to the field of communications technologies, so that the pillar-shaped luneberg lens antenna can support dual polarization and improve a capacity of a communications system. The pillar-shaped luneberg lens antenna includes two metal plates that are parallel to each other and a pillar-shaped luneberg lens disposed between the two metal plates, the pillar-shaped luneberg lens includes a main layer and a compensation layer that are of the pillar-shaped luneberg lens, and the compensation layer is configured to compensate for equivalent dielectric constants of the main layer of the pillar-shaped luneberg lens in a TEM mode and/or a TE10 mode, so that distribution of equivalent dielectric constants of the pillar-shaped luneberg lens in the (Continued)

TEM mode and the TE10 mode is consistent with distribution of preset dielectric constants.

14 Claims, 9 Drawing Sheets

(56) References Cited

U.S. PATENT DOCUMENTS

| | | | |
|---|---|---|---|
| 2015/0168601 | A1 | 6/2015 | Suzuki |
| 2018/0097290 | A1 | 4/2018 | Matitsine et al. |

FOREIGN PATENT DOCUMENTS

| | | | | | |
|---|---|---|---|---|---|
| CN | 102122762 | A | | 7/2011 | |
| CN | 103022727 | A | | 4/2013 | |
| CN | 105428821 | A | * | 3/2016 | |
| CN | 105428821 | A | | 3/2016 | |
| CN | 105470658 | A | | 4/2016 | |
| CN | 105470659 | A | | 4/2016 | |
| CN | 105470660 | A | * | 4/2016 | ..... H01Q 15/00 |
| CN | 105470660 | A | | 4/2016 | |
| CN | 105552573 | A | | 5/2016 | |
| CN | 107275788 | A | | 10/2017 | |
| CN | 105552572 | B | | 3/2018 | |
| EP | 2816667 | B1 | | 5/2017 | |
| GB | 1166105 | A | | 10/1969 | |
| JP | 2001085936 | A | | 3/2001 | |

OTHER PUBLICATIONS

Hua et al., "Millimeter-Wave Fan-Beam Antenna Based on Step-Index Cylindrical Homogeneous Lens," IEEE Antennas and Wireless Propagation Letters, vol. 11, pp. 1512-1516 (2012).

Guan Zhengtao, "Design of a V-band Column Luneburg Lens Antenna," Telecommunication Engineering, vol. 57 No. 6, total 4 pages (Jun. 2017). With English abstract.

Dhouibi et al., "Compact Metamaterial-Based Substrate-Integrated Luneburg Lens Antenna," IEEE Antennas and Wireless Propagation Letters, vol. 11, pp. 1504-1507 (2012).

Chou et al., "Parallel-Plate Luneburg Lens Antenna for Broadband Multibeam Radiation at Millimeter-Wave Frequencies With Design Optimization," IEEE Transactions on Antennas and Propagation, vol. 66, No. 11, pp. 5794-5804, XP011694210, Institute of Electrical and Electronics Engineers, New York, New York (Nov. 2018).

Zhang et al., "A Cylindrical Luneberg Lens Antenna with Extremely Wide Fan-Beam," 2018 IEEE International Symposium on Antennas and Propagation & USNC/URSI National Radio Science Meeting, pp. 113-114, XP033496860, Institute of Electrical and Electronics Engineers, New York, New York (Jul. 2018).

* cited by examiner

PILLAR-SHAPED LUNEBERG LENS ANTENNA AND PILLAR-SHAPED LUNEBERG LENS ANTENNA ARRAY

CROSS-REFERENCE TO RELATED APPLICATIONS

This application is a continuation of International Application No. PCT/CN2019/121921, filed on Nov. 29, 2019, which claims priority to Chinese Patent Application No. 201811459192.7, filed on Nov. 30, 2018. The disclosures of the aforementioned applications are hereby incorporated by reference in their entireties.

TECHNICAL FIELD

This application relates to the field of communications technologies, and in particular, to a pillar-shaped luneberg lens antenna and a pillar-shaped luneberg lens antenna array.

BACKGROUND

With rapid development of an information society, mobile communications technologies are advancing towards the fifth generation of mobile communications technologies (namely, 5G). As one of remarkable changes of the 5G, a millimeter-wave band is planned for mobile communications by spectrum management organizations in various countries or regions. The millimeter-wave band has a larger bandwidth than that of a low frequency band commonly used in the 3G or 4G era, and can alleviate frequency resource shortage and bandwidth insufficiency in the low frequency band. It is likely for the millimeter-wave band to greatly increase a capacity of a communications system.

However, high attenuation of millimeter-wave propagation in space poses challenges of a high gain and a wide scanning angle to an antenna design of a wireless communications system. As a classic electromagnetic lens, a luneberg lens can greatly improve an antenna gain by focusing on an electromagnetic wave and has a very wide scanning angle due to a rotational symmetry characteristic of the luneberg lens. In addition, a lens architecture has advantages in reducing a quantity of channels and reducing system complexity.

A classic luneberg lens is a spherical lens with a graded refractive index. A relationship between a refractive index n (or a dielectric constant εr) and unified radii r/R (r is a distance from each dielectric part in the luneberg lens to a sphere center of the luneberg lens, and R is a radius of the luneberg lens) is:

$$n=\sqrt{\varepsilon_r}=\sqrt{2-(r/R)^2} \quad (1)$$

That is, the refractive index n or the dielectric constant εr decreases gradually from the sphere center to a sphere surface. However, in the conventional technology, it is relatively difficult to process a sphere with a changed dielectric constant along a radial direction, thereby limiting an application range of the classic luneberg lens. To avoid this problem, a pillar-shaped luneberg lens 01, also referred to as a two-dimensional luneberg lens or a planar luneberg lens, appears in the conventional technology. As shown in FIG. 1, the pillar-shaped luneberg lens 01 is in a structure of a circular plate, and is arranged from inside to outside along a radial direction of the pillar-shaped luneberg lens 01. A dielectric constant of the pillar-shaped luneberg lens 01 gradually decreases, so that advantages of a high gain and wide scanning can be retained to some extent. In addition, compared with the sphere whose dielectric constant gradually changes along the radial direction, a processing difficulty of the pillar-shaped luneberg lens 01 is greatly reduced. FIG. 2 shows a pillar-shaped luneberg lens antenna in the conventional technology. The pillar-shaped luneberg lens antenna includes two metal plates 02 that are parallel to each other, the pillar-shaped luneberg lens 01 disposed between the two metal plates 02, and a feed 03 opposite to a side wall of the pillar-shaped luneberg lens 01. However, when the pillar-shaped luneberg lens 01 is used in an antenna to form a pillar-shaped luneberg lens antenna, the pillar-shaped luneberg lens antenna supports only single polarization, so that a capacity of a communications system including the pillar-shaped luneberg lens antenna is relatively small.

SUMMARY

Embodiments of this application provide a pillar-shaped luneberg lens antenna and a pillar-shaped luneberg lens antenna array, wherein the pillar-shaped luneberg lens antenna can support dual polarization and improve a capacity of a communications system.

To achieve the foregoing objectives, the following technical solutions are used in the embodiments of this application.

According to a first aspect, some embodiments of this application provide a pillar-shaped luneberg lens antenna. The pillar-shaped luneberg lens antenna includes two metal plates parallel to each other and a pillar-shaped luneberg lens disposed between the two metal plates. The pillar-shaped luneberg lens includes a main layer and a compensation layer that are of the pillar-shaped luneberg lens. The compensation layer is configured to compensate for equivalent dielectric constants of the main layer of the pillar-shaped luneberg lens in a TEM mode and/or a TE10 mode. Therefore, distribution of equivalent dielectric constants of the pillar-shaped luneberg lens in the TEM mode and the TE10 mode is consistent with distribution of preset dielectric constants.

The distribution of the preset dielectric constants meets the following condition:

When the distribution of the equivalent dielectric constants of the pillar-shaped luneberg lens in the TEM mode is consistent with the distribution of the preset dielectric constants, the pillar-shaped luneberg lens antenna can implement polarization in a direction orthogonal to the metal plate; and when the distribution of the equivalent dielectric constants of the pillar-shaped luneberg lens in the TE10 mode is consistent with the distribution of the preset dielectric constants, the pillar-shaped luneberg lens antenna can implement polarization in a direction parallel to the metal plates.

Compared with the conventional technology, the pillar-shaped luneberg lens in the pillar-shaped luneberg lens antenna provided in the embodiments of this application includes the main layer and the compensation layer that are of the pillar-shaped luneberg lens. The compensation layer is configured to compensate for the equivalent dielectric constants of the main layer of the pillar-shaped luneberg lens in the TEM mode and/or the TE10 mode, so that the distribution of the equivalent dielectric constants of the pillar-shaped luneberg lens in the TEM mode and the TE10 mode can be consistent with the distribution of the preset dielectric constants. In addition, when the distribution of the equivalent dielectric constants of the pillar-shaped luneberg lens in the TEM mode is consistent with the distribution of the preset dielectric constants, the pillar-shaped luneberg lens antenna provided in the embodiments of this application can implement the polarization in the direction orthogonal to the metal plates (e.g., vertical polarization). When the distribution of the equivalent dielectric constants of the pillar-shaped luneberg lens in the TE10 mode is consistent with the distribution of the preset dielectric constants, the pillar-shaped luneberg lens antenna provided in the embodiments of this application can implement the polarization in the direction parallel to the metal plates (namely, horizontal polarization). Therefore, when the distribution of the equivalent dielectric constants of the pillar-shaped luneberg lens in the TEM mode and the TE10 mode is consistent with the distribution of the preset dielectric constants, the pillar-shaped luneberg lens antenna provided in the embodiments of this application can implement polarization in both a vertical direction and a horizontal direction at the same time, thereby improving a capacity of a communications system.

In some embodiments, the distribution of the preset dielectric constants is distribution of dielectric constants of a classic luneberg lens. When the distribution of the equivalent dielectric constants of the pillar-shaped luneberg lens in the TEM mode is consistent with the distribution of the dielectric constants of the classic luneberg lens, the pillar-shaped luneberg lens antenna provided in the embodiments of this application can implement the vertical polarization. When the distribution of the equivalent dielectric constants of the pillar-shaped luneberg lens in the TE10 mode is consistent with the distribution of the dielectric constants of the classic luneberg lens, the pillar-shaped luneberg lens antenna provided in the embodiments of this application can implement the horizontal polarization. Therefore, when the distribution of the dielectric constants of the pillar-shaped luneberg lens in the TEM mode and the TE10 mode is consistent with the distribution of the dielectric constants of the classic luneberg lens, the pillar-shaped luneberg lens antenna provided in the embodiments of this application can implement both the vertical polarization and the horizontal polarization at the same time, thereby improving the capacity of the communications system.

Optionally, the distribution of the equivalent dielectric constants of the main layer of the pillar-shaped luneberg lens in the TEM mode is consistent with the distribution of the preset dielectric constants, and the compensation layer is configured to positively compensate for the equivalent dielectric constants of the main layer of the pillar-shaped luneberg lens in the TE10 mode, so that the distribution of the equivalent dielectric constants of the pillar-shaped luneberg lens in the TE10 mode is consistent with the distribution of the preset dielectric constants. In this way, the pillar-shaped luneberg lens antenna provided in the embodiments of this application can implement both the vertical polarization and the horizontal polarization at the same time, thereby improving the capacity of the communications system. In addition, the compensation layer only compensates for the equivalent dielectric constants of the main layer of the pillar-shaped luneberg lens in the TE10 mode. Therefore, a structure of the compensation layer is simple and easy to implement.

Optionally, the compensation layer includes a sheet-like substrate, the sheet-like substrate is parallel to the metal plate, the sheet-like substrate includes a first surface and a second surface that are opposite to each other, and a metal sheet array is pasted on the first surface and/or the second surface. In this way, a metamaterial layer is formed at the compensation layer, and the metamaterial layer can positively compensate for the equivalent dielectric constants of the main layer of the pillar-shaped luneberg lens in the TE10 mode. In addition, the metamaterial layer has no effect on the equivalent dielectric constants of the main layer of the pillar-shaped luneberg lens in the TEM mode, and can only positively compensate for the equivalent dielectric constants of the main layer of the pillar-shaped luneberg lens in the TE10 mode on the premise that the distribution of the equivalent dielectric constants of the main layer of the pillar-shaped luneberg lens in the TEM mode is consistent with the distribution of the preset dielectric constants, so that the distribution of the dielectric constants of the pillar-shaped luneberg lens in the TE10 mode is consistent with the distribution of the preset dielectric constants. In addition, when the pillar-shaped luneberg lens is manufactured, a plurality of metal sheets included in the metal sheet array may be first disposed on the sheet-like substrate, to ensure relative position precision between the plurality of metal sheets. Then, an entirety formed by the metal sheet array and the sheet-like substrate is assembled together with the main layer of the pillar-shaped luneberg lens to form the pillar-shaped luneberg lens. This manufacturing process is simple and easy to implement, and can effectively ensure the relative position precision between the plurality of metal sheets.

The metal sheet array includes the plurality of metal sheets. Shapes of the metal sheets include but are not limited to a circle, a square, a triangle, and a heart shape. In addition, a specific size parameter of each metal sheet, an array mode of the plurality of metal sheets, and a spacing between two adjacent metal sheets need to be determined based on a magnitude of the positive compensation of the compensation layer. For example, a shape of the metal sheet is a circle.

The sheet-like substrate is made of an insulating material or a semiconductor material. In some embodiments, the sheet-like substrate is a circuit board substrate. For example, the sheet-like substrate is a circuit board substrate made of a polytetrafluoroethylene (PTFE) material.

Optionally, the compensation layer includes a plurality of metal sheets arranged in a same plane, the plane in which the plurality of metal sheets are located is parallel to the metal plate, and each metal sheet is parallel to the metal plate. In this way, a metamaterial layer is formed at the compensation layer, and the metamaterial layer can positively compensate for the equivalent dielectric constants of the main layer of the pillar-shaped luneberg lens in the TE10 mode. In addition, the metamaterial layer has no effect on the equivalent dielectric constants of the main layer of the pillar-shaped luneberg lens in the TEM mode, and can only positively compensate for the equivalent dielectric constants of the main layer of the pillar-shaped luneberg lens in the TE10 mode on the premise that the distribution of the equivalent dielectric constants of the main layer of the pillar-shaped luneberg lens in the TEM mode is consistent with the distribution of the preset dielectric constants, so that the distribution of the dielectric constants of the pillar-shaped luneberg lens in the TE10 mode is consistent with the distribution of the preset dielectric constants. In addition, the structure is simple, and the sheet-like substrate does not need to be disposed. Therefore, costs are relatively low, and an effect on a thickness of the pillar-shaped luneberg lens is relatively slight.

Optionally, the compensation layer is disposed in a middle part of the main layer of the pillar-shaped luneberg lens along an axis of the main layer of the pillar-shaped luneberg lens. In this way, the compensation layer can effectively compensate for the equivalent dielectric constants of the main layer of the pillar-shaped luneberg lens in the TE10 mode, so that the distribution of the equivalent dielectric constants of the pillar-shaped luneberg lens in the TE10 mode is consistent with the distribution of the preset dielectric constants.

Optionally, the distribution of the equivalent dielectric constants of the main layer of the pillar-shaped luneberg lens in the TE10 mode is consistent with the distribution of the preset dielectric constants, and the compensation layer is configured to negatively compensate the equivalent dielectric constants of the main layer of the pillar-shaped luneberg lens in the TEM mode, so that the distribution of the equivalent dielectric constants of the pillar-shaped luneberg lens in the TEM mode is consistent with the distribution of the preset dielectric constants. In this way, the pillar-shaped luneberg lens antenna provided in the embodiments of this application can implement both the vertical polarization and the horizontal polarization at the same time, thereby improving the capacity of the communications system. In addition, the compensation layer only compensates for the equivalent dielectric constants of the main layer of the pillar-shaped luneberg lens in the TEM mode. Therefore, a structure of the compensation layer is simple and easy to implement.

In some embodiments, the compensation layer is a dielectric layer whose equivalent dielectric constants are less than a minimum equivalent dielectric constant of the main layer of the pillar-shaped luneberg lens, the compensation layer and the main layer of the pillar-shaped luneberg lens are stacked layer by layer, and the compensation layer is located at at least one end of the pillar-shaped luneberg lens along an axis of the main layer of the pillar-shaped luneberg lens. In this way, the compensation layer can negatively compensate for the equivalent dielectric constants of the main layer of the pillar-shaped luneberg lens in the TEM mode. In addition, the compensation layer has slight effect on the equivalent dielectric constants of the main layer of the pillar-shaped luneberg lens in the TE10 mode, and can only negatively compensate for the equivalent dielectric constants of the main layer of the pillar-shaped luneberg lens in the TEM mode on the premise that the distribution of the equivalent dielectric constants of the main layer of the pillar-shaped luneberg lens in the TE10 mode is consistent with the distribution of the preset dielectric constants, so that the distribution of the dielectric constants of the pillar-shaped luneberg lens in the TEM mode is consistent with the distribution of the preset dielectric constants. Specifically, the compensation layer includes but is not limited to an air layer, a vacuum layer, and a foam layer.

Optionally, all equivalent dielectric constants of the main layer of the pillar-shaped luneberg lens in the TEM mode along each radial position of the main layer of the pillar-shaped luneberg lens are greater than dielectric constants at corresponding radii in the distribution of the preset dielectric constants. All equivalent dielectric constants of the main layer of the pillar-shaped luneberg lens in the TE10 mode along each radial position of the main layer of the pillar-shaped luneberg lens are less than dielectric constants at corresponding radii in the distribution of the preset dielectric constants. The compensation layer is configured to negatively compensate for the equivalent dielectric constants of the main layer of the pillar-shaped luneberg lens in the TEM mode, and positively compensate for the equivalent dielectric constants of the main layer of the pillar-shaped luneberg lens in the TE10 mode. Therefore, the distribution of the equivalent dielectric constants of the pillar-shaped luneberg lens in the TEM mode and in the TE10 mode are consistent with the distribution of the preset dielectric constants. In this way, the pillar-shaped luneberg lens antenna provided in the embodiments of this application can implement both the vertical polarization and the horizontal polarization at the same time, thereby improving the capacity of the communications system.

In some embodiments, the compensation layer includes a first compensation layer and a second compensation layer. The first compensation layer is configured to negatively compensate for the equivalent dielectric constants of the main layer of the pillar-shaped luneberg lens in the TEM mode, so that the distribution of the equivalent dielectric constants of the pillar-shaped luneberg lens in the TEM mode is consistent with the distribution of the preset dielectric constants. The second compensation layer is configured to positively compensate for the equivalent dielectric constants of the main layer of the pillar-shaped luneberg lens in the TE10 mode, so that the distribution of the equivalent dielectric constants of the pillar-shaped luneberg lens in the TE10 mode is consistent with the distribution of the preset dielectric constants. In this way, the pillar-shaped luneberg lens antenna provided in the embodiments of this application can implement both the vertical polarization and the horizontal polarization at the same time, thereby improving the capacity of the communications system.

Optionally, the main layer of the pillar-shaped luneberg lens is in a shape of a circular flat plate. In this way, a thickness of each position on the main layer of the pillar-shaped luneberg lens is uniform and consistent. This makes the pillar-shaped luneberg lens more easier to process.

In some embodiments, the main layer of the pillar-shaped luneberg lens includes a plurality of annular dielectric layers that are successively disposed from inside to outside along a radial direction of the main layer of the pillar-shaped luneberg lens, the plurality of annular dielectric layers are made of different materials, and dielectric constants of the materials of the plurality of annular dielectric layers gradually decrease from inside to outside along the radial direction of the main layer of the pillar-shaped luneberg lens. In this way, different dielectric constants of the material are used, and the distribution of the dielectric constants of the main layer of the pillar-shaped luneberg lens is simulated. This structure is simple and easy to implement.

In some other embodiments, the main layer of the pillar-shaped luneberg lens includes a circular substrate, a plurality of through holes are disposed on the substrate, and a porosity rate of the substrate gradually increases from inside to outside along the radial direction of the main layer of the pillar-shaped luneberg lens. In this way, the porosity rate with different values is used, the distribution of the dielectric constants of the main layer of the pillar-shaped luneberg lens is simulated, and a plurality of materials do not need to be disposed. Therefore, the structure is simple, and the costs are relatively low.

Optionally, the pillar-shaped luneberg lens antenna further includes a dual-polarization feed opposite to a side wall of the main layer of the pillar-shaped luneberg lens. The dual-polarization feed includes but is not limited to a dual-polarization microstrip patch, a dual-polarization plane Yagi antenna, a dual-polarization conical dielectric antenna, a dual-polarization open-end waveguide antenna, or a dual-polarization horn antenna.

Optionally, the pillar-shaped luneberg lens antenna further includes a dual-polarization feed opposite to a side wall of the main layer of the pillar-shaped luneberg lens. There are a plurality of dual-polarization feeds, and the plurality of dual-polarization feeds are sequentially arranged along a circumferential direction of the main layer of the pillar-shaped luneberg lens. In this way, a switch is switched to input signals to different dual-polarization feeds, and rotation scanning can be implemented in a plane parallel to the metal plate, thereby increasing a scanning angle of the pillar-shaped luneberg lens antenna. In addition, signals can be input to the plurality of dual-polarization feeds at the same time, so that a plurality of beams can work at the same time.

According to a second aspect, some embodiments of this application provide a pillar-shaped luneberg lens antenna array, including a plurality of pillar-shaped luneberg lens antennas according to any one of the foregoing technical solutions. The plurality of pillar-shaped luneberg lens antennas are sequentially stacked along an extension direction of a central axis of a main layer of the pillar-shaped luneberg lens antenna.

Compared with the conventional technology, the pillar-shaped luneberg lens antenna array provided in some embodiments of this application includes the plurality of pillar-shaped luneberg lens antennas according to any one of the foregoing technical solutions. The pillar-shaped luneberg lens antenna described in any one of the foregoing technical solutions can implement the polarization in both the vertical direction and the horizontal direction at the same time, and improve the capacity of the communications system. Therefore, the pillar-shaped luneberg lens antenna array provided in the embodiments of this application can implement the polarization in both the vertical direction and the horizontal direction, improve the capacity of the communications system, and input signals with different phases to the plurality of pillar-shaped luneberg lens antennas to implement beam scanning in the plane vertical to the metal plate in the pillar-shaped luneberg lens antenna.

DESCRIPTION OF EMBODIMENTS

Figure 1:
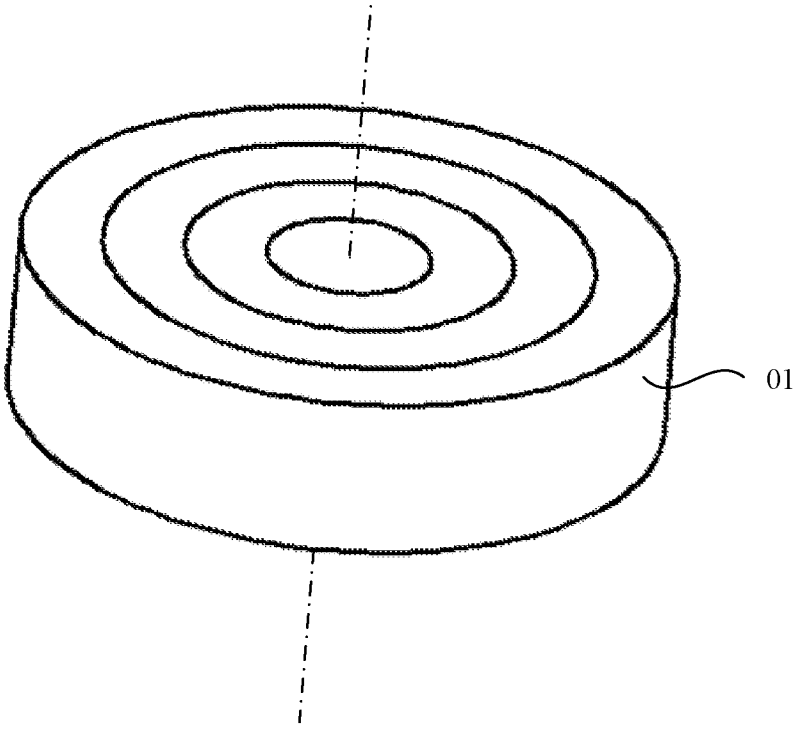
FIG. 1 is a schematic structural diagram of a pillar-shaped luneberg lens in the conventional technology.

It should be noted that "and/or" in descriptions of embodiments of this application describes only an association relationship for describing associated objects and represents that three relationships may exist. For example, A and/or B may represent the following three cases: Only A exists, both A and B exist, and only B exists. In addition, the character "/" in this specification usually indicates an "or" relationship between the associated objects.

According to a first aspect, some embodiments of this application provide a pillar-shaped luneberg lens antenna 1. As shown in FIG. 3 to FIG. 11, the pillar-shaped luneberg lens antenna 1 includes two metal plates 11 parallel to each other and a pillar-shaped luneberg lens 12 disposed between the two metal plates 11. The pillar-shaped luneberg lens 12 includes a main layer 121 and a compensation layer 122, where the compensation layer 122 is configured to compensate for equivalent dielectric constants of the main layer 121 of the pillar-shaped luneberg lens in a TEM mode and/or a TE10 mode, so that distribution of equivalent dielectric constants of the pillar-shaped luneberg lens 12 in the TEM mode and the TE10 mode is consistent with distribution of preset dielectric constants.

It should be noted that the distribution of the preset dielectric constants is distribution of dielectric constants that meets the following condition: When the distribution of the equivalent dielectric constants of the pillar-shaped luneberg lens 12 in the TEM mode is consistent with the distribution of the preset dielectric constants, the pillar-shaped luneberg lens antenna 1 can implement polarization in a direction vertical to the metal plate 11; and when the distribution of the equivalent dielectric constants of the pillar-shaped luneberg lens 12 in the TE10 mode is consistent with the distribution of the preset dielectric constants, the pillar-shaped luneberg lens antenna 1 can implement polarization in a direction parallel to the metal plate 11.

It should be noted that, that the distribution of the equivalent dielectric constants of the pillar-shaped luneberg lens 12 in the TEM mode is consistent with the distribution of the preset dielectric constants does not mean that the distribution of the equivalent dielectric constants of the pillar-shaped luneberg lens 12 in the TEM mode is exactly the same as the distribution of the preset dielectric constants, but means that when an absolute value $|\varepsilon_{r_eff1}-\varepsilon_r|/\varepsilon_r$ of a difference between an equivalent dielectric constant $\varepsilon_{r_eff1}$ at a radius r on the pillar-shaped luneberg lens 12 in the TEM mode and a dielectric constant $\varepsilon_r$ at the radius r in the distribution of the preset dielectric constants is less than or equal to 10%, it may be considered that the distribution of the equivalent dielectric constants of the pillar-shaped luneberg lens 12 in the TEM mode is consistent with the distribution of the preset dielectric constants. $0 \le r \le R$, and R is a radius of the pillar-shaped luneberg lens. Similarly, that the distribution of the equivalent dielectric constants of the pillar-shaped luneberg lens 12 in the TE10 mode is consistent with the distribution of the preset dielectric constants does not mean that the distribution of the equivalent dielectric constants of the pillar-shaped luneberg lens 12 in the TE10 mode is exactly the same as the distribution of the preset dielectric constants, but means that when an absolute value $|\varepsilon_{r_eff2}-\varepsilon_r|/\varepsilon_r$ of a difference between an equivalent dielectric constant $\varepsilon_{r_eff2}$ at a radius r on the pillar-shaped luneberg lens 12 in the TE10 mode and a dielectric constant $\varepsilon_r$ at the radius r in the distribution of the preset dielectric constants is less than or equal to 10%, it may be considered that the distribution of the equivalent dielectric constants of the pillar-shaped luneberg lens 12 in the TE10 mode is consistent with the distribution of the preset dielectric constants.

Compared with the conventional technology, the pillar-shaped luneberg lens 12 in the pillar-shaped luneberg lens antenna 1 provided in the embodiments of this application includes the main layer 121 and the compensation layer 122 that are of the pillar-shaped luneberg lens. The compensation layer 122 is configured to compensate for the equivalent dielectric constants of the main layer 121 of the pillar-shaped luneberg lens in the TEM mode and/or the TE10 mode, so that the distribution of the equivalent dielectric constants of the pillar-shaped luneberg lens 12 in the TEM mode and the TE10 mode can be consistent with the distribution of the preset dielectric constants. In addition, when the distribution of the equivalent dielectric constants of the pillar-shaped luneberg lens 12 in the TEM mode is consistent with the distribution of the preset dielectric constants, the pillar-shaped luneberg lens antenna 1 provided in the embodiments of this application can implement the polarization in the direction vertical to the metal plate 11 (namely, vertical polarization). When the distribution of the equivalent dielectric constants of the pillar-shaped luneberg lens 12 in the TE10 mode is consistent with the distribution of the preset dielectric constants, the pillar-shaped luneberg lens antenna 1 provided in the embodiments of this application can implement the polarization in the direction parallel to the metal plate 11 (namely, horizontal polarization). Therefore, when the distribution of the equivalent dielectric constants of the pillar-shaped luneberg lens 12 in the TEM mode and the TE10 mode is consistent with the distribution of the preset dielectric constants, the pillar-shaped luneberg lens antenna 1 provided in the embodiments of this application can implement polarization in both a vertical direction and a horizontal direction at the same time, thereby improving a capacity of a communications system.

In some embodiments, the distribution of the preset dielectric constants is distribution of dielectric constants of a classic luneberg lens. Based on the expression (1) in the background, the distribution of the dielectric constants of the classic luneberg lens may be deduced as: $\varepsilon_r=2-(r/R)^2$. When the distribution of the equivalent dielectric constants of the pillar-shaped luneberg lens 12 in the TEM mode is consistent with the distribution of the dielectric constants of the classic luneberg lens, the pillar-shaped luneberg lens antenna 1 provided in the embodiments of this application can implement the vertical polarization. When the distribution of the equivalent dielectric constants of the pillar-shaped luneberg lens 12 in the TE10 mode is consistent with the distribution of the dielectric constants of the classic luneberg lens, the pillar-shaped luneberg lens antenna 1 provided in the embodiments of this application can implement the horizontal polarization. Therefore, when the distribution of the dielectric constants of the pillar-shaped luneberg lens 12 in the TEM mode and the TE10 mode is consistent with the distribution of the dielectric constants of the classic luneberg lens, the pillar-shaped luneberg lens antenna 1 provided in the embodiments of this application can implement both the vertical polarization and the horizontal polarization at the same time, thereby improving the capacity of the communications system.

Figure 5:
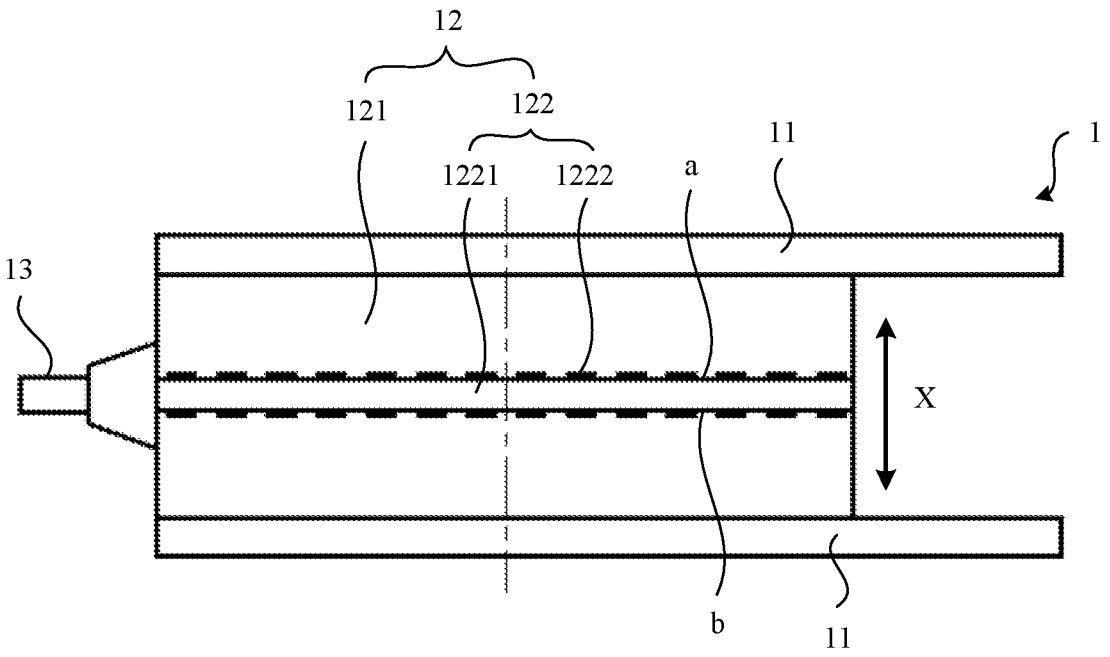
FIG. 5 is a main view of a third structure of a pillar-shaped luneberg lens antenna according to an embodiment of this application.
Figure 6:
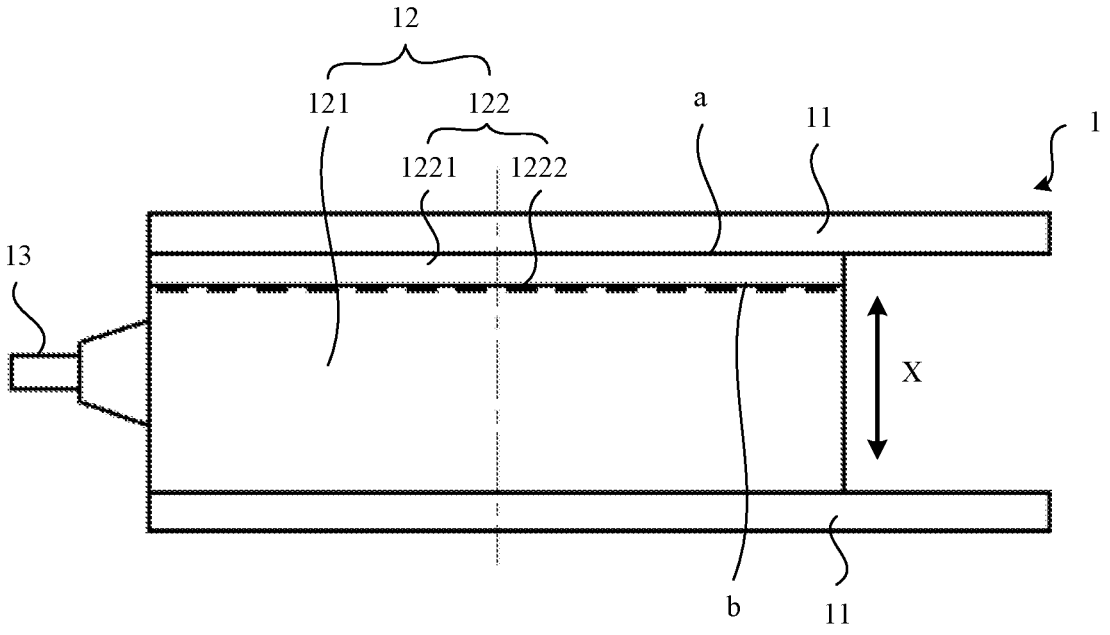
FIG. 6 is a main view of a fourth structure of a pillar-shaped luneberg lens antenna according to an embodiment of this application.
Figure 7:
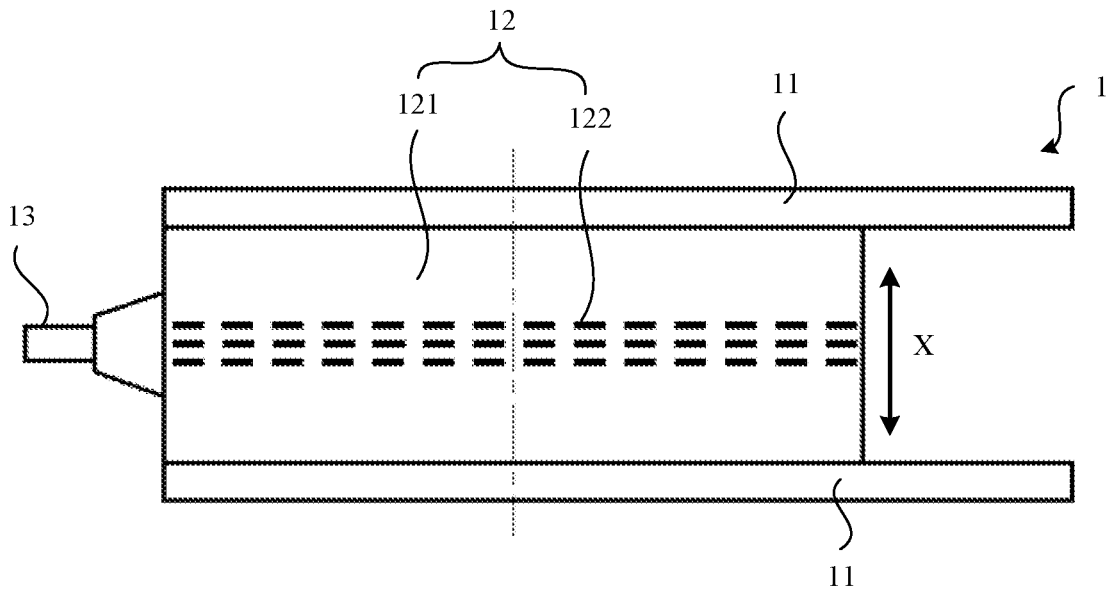
FIG. 7 is a main view of a fifth structure of a pillar-shaped luneberg lens antenna according to an embodiment of this application.

Optionally, as shown in FIG. 5, FIG. 6, or FIG. 7, the distribution of the equivalent dielectric constants of the main layer 121 of the pillar-shaped luneberg lens in the TEM mode is consistent with the distribution of the preset dielectric constants, and the compensation layer 122 is configured to positively compensate for the equivalent dielectric constants of the main layer 121 of the pillar-shaped luneberg lens in the TE10 mode, so that the distribution of the equivalent dielectric constants of the pillar-shaped luneberg lens 12 in the TE10 mode is consistent with the distribution of the preset dielectric constants. In this way, the pillar-shaped luneberg lens antenna 1 provided in the embodiments of this application can implement both the vertical polarization and the horizontal polarization at the same time, thereby improving the capacity of the communications system. In addition, the compensation layer 122 only compensates for the equivalent dielectric constants of the main layer 121 of the pillar-shaped luneberg lens in the TE10 mode. Therefore, a structure of the compensation layer 122 is simple and easy to implement.

In the foregoing embodiments, the compensation layer 122 may be disposed in an end part of the main layer 121 of the pillar-shaped luneberg lens along an axis (namely, a direction X) of the main layer 121 of the pillar-shaped luneberg lens (as shown in FIG. 6), or may also be disposed in a middle part of the main layer 121 of the pillar-shaped luneberg lens along an axis (also namely, a direction X) of the main layer 121 of the pillar-shaped luneberg lens. This is not specifically limited herein. In some embodiments, as shown in FIG. 5 or FIG. 7, the compensation layer 122 is disposed in the middle part of the main layer 121 of the pillar-shaped luneberg lens along the axis of the main layer 121 of the pillar-shaped luneberg lens. In this way, the compensation layer 122 can effectively compensate for the equivalent dielectric constants of the main layer 121 of the pillar-shaped luneberg lens 12 in the TE10 mode, so that the distribution of the equivalent dielectric constants of the pillar-shaped luneberg lens 12 in the TE10 mode is consistent with the distribution of the preset dielectric constants.

Optionally, as shown in FIG. 5 or FIG. 6, the compensation layer 122 includes a sheet-like substrate 1221, the sheet-like substrate 1221 is parallel to the metal plate 11, the sheet-like substrate 1221 includes a first surface a and a second surface b that are opposite to each other, and a metal sheet array 1222 is pasted on the first surface a and/or the second surface b. In this way, a metamaterial layer is formed at the compensation layer 122, and the metamaterial layer can positively compensate for the equivalent dielectric constants of the main layer 121 of the pillar-shaped luneberg lens in the TE10 mode. In addition, the metamaterial layer has no effect on the equivalent dielectric constants of the main layer 121 of the pillar-shaped luneberg lens in the TEM mode, and can only positively compensate for the equivalent dielectric constants of the main layer 121 of the pillar-shaped luneberg lens in the TE10 mode on the premise that the distribution of the equivalent dielectric constants of the main layer 121 of the pillar-shaped luneberg lens in the TEM mode is consistent with the distribution of the preset dielectric constants, so that the distribution of the dielectric constants of the pillar-shaped luneberg lens 12 in the TE10 mode is consistent with the distribution of the preset dielectric constants. In addition, when the pillar-shaped luneberg lens 12 is manufactured, a plurality of metal sheets included in the metal sheet array 1222 may be first disposed on the sheet-like substrate 1221, to ensure relative position precision between the plurality of metal sheets. Then, an entirety formed by the metal sheet array 1222 and the sheet-like substrate 1221 is assembled together with the main layer 121 of the pillar-shaped luneberg lens to form the pillar-shaped luneberg lens 12. This manufacturing process is simple and easy to implement, and can effectively ensure the relative position precision between the plurality of metal sheets.

In the foregoing embodiments, there may be one compensation layer 122, or may be a plurality of compensation layers 122. This is not specifically limited herein. In some embodiments, there are a plurality of compensation layers 122, and the plurality of compensation layers 122 are pressed together to form a metal sheet array with two or more layers. A structure formed by the plurality of compensation layers 122 may be manufactured by using a multilayer circuit production technology.

As shown in FIG. 5 or FIG. 6, the metal sheet array 1222 may be bonded to the first surface a and/or the second surface b that are of the sheet-like substrate 1221 by using glue, or may be directly formed on the first surface a and/or the second surface b that are of the sheet-like substrate 1221. This is not specifically limited herein. In some embodiments, the metal sheet array 1222 is formed on the first surface a and/or the second surface b that are of the sheet-like substrate 1221 by using a printed circuit technology.

The metal sheet array 1222 may be disposed only on the first surface a of the sheet-like substrate 1221, may be disposed only on the second surface b of the sheet-like substrate 1221, or may be disposed on both the first surface a and the second surface b that are of the sheet-like substrate 1221 at the same time. This is not specifically limited herein. In some embodiments, as shown in FIG. 6, the metal sheet array 1222 may be disposed only on the second surface b of the sheet-like substrate 1221. In some other embodiments, as shown in FIG. 5, the metal sheet array 1222 is disposed on both the first surface a and the second surface b that are of the sheet-like substrate 1221 at the same time.

The metal sheet array 122 includes the plurality of metal sheets. Shapes of the metal sheets may include but be not limited to a circle, a square, a triangle, and a heart shape. In addition, a specific size parameter of each metal sheet, an array mode of the plurality of metal sheets, and a spacing between two adjacent metal sheets need to be determined based on a magnitude of the positive compensation of the compensation layer. In some embodiments, a shape of the metal sheet is a circle.

The sheet-like substrate 1221 is made of an insulating material or a semiconductor material. In some embodiments, the sheet-like substrate 1221 is a circuit board substrate. For example, the sheet-like substrate 1221 is a circuit board substrate formed by a polytetrafluoroethylene (PTFE) material. In this way, the metal sheet array 1222 may be formed on the sheet-like substrate 1221 by using the printed circuit technology.

Optionally, as shown in FIG. 7, the compensation layer 122 includes a plurality of metal sheets arranged in a same plane, the plane in which the plurality of metal sheets are located is parallel to the metal plate 11, and each metal sheet is parallel to the metal plate 11. In this way, a metamaterial layer is formed at the compensation layer, and the metamaterial layer can positively compensate for the equivalent dielectric constants of the main layer 121 of the pillar-shaped luneberg lens in the TE10 mode. In addition, the metamaterial layer has no effect on the equivalent dielectric constants of the main layer 121 of the pillar-shaped luneberg lens in the TEM mode, and can only positively compensate for the equivalent dielectric constants of the main layer 121 of the pillar-shaped luneberg lens in the TE10 mode on the premise that the distribution of the equivalent dielectric constants of the main layer 121 of the pillar-shaped luneberg lens in the TEM mode is consistent with the distribution of the preset dielectric constants, so that the distribution of the dielectric constants of the pillar-shaped luneberg lens 12 in the TE10 mode is consistent with the distribution of the preset dielectric constants. In addition, the structure is simple, and an effect on a thickness of the pillar-shaped luneberg lens is relatively slight. There may be one compensation layer 122, or may be a plurality of compensation layers 122. This is not specifically limited herein. In some embodiments, as shown in FIG. 7, there are three compensation layers.

Figure 3:
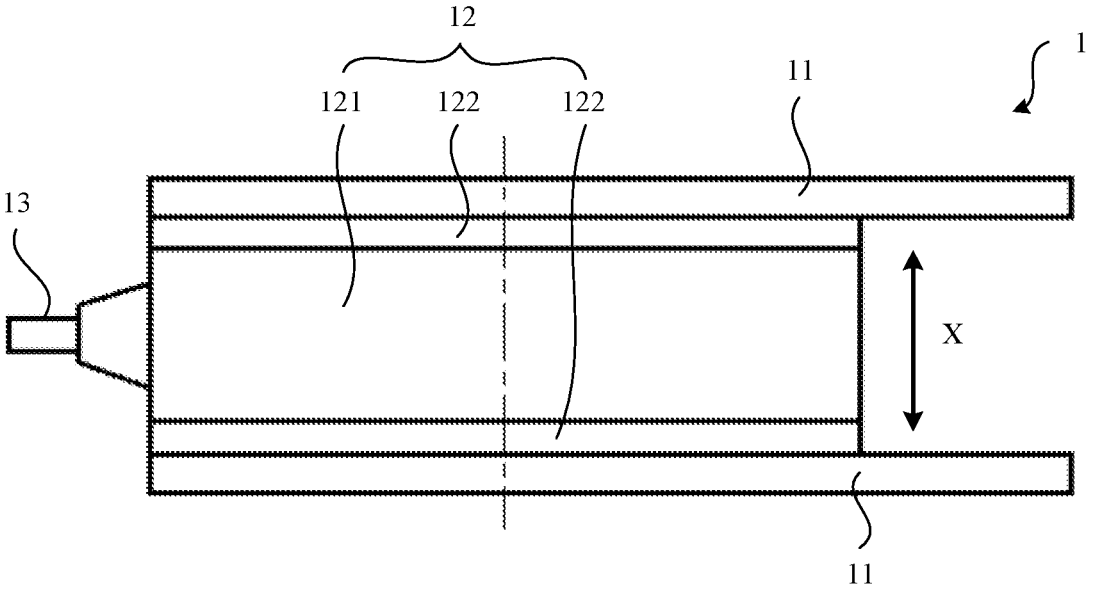
FIG. 3 is a main view of a first structure of a pillar-shaped luneberg lens antenna according to an embodiment of this application.
Figure 4:
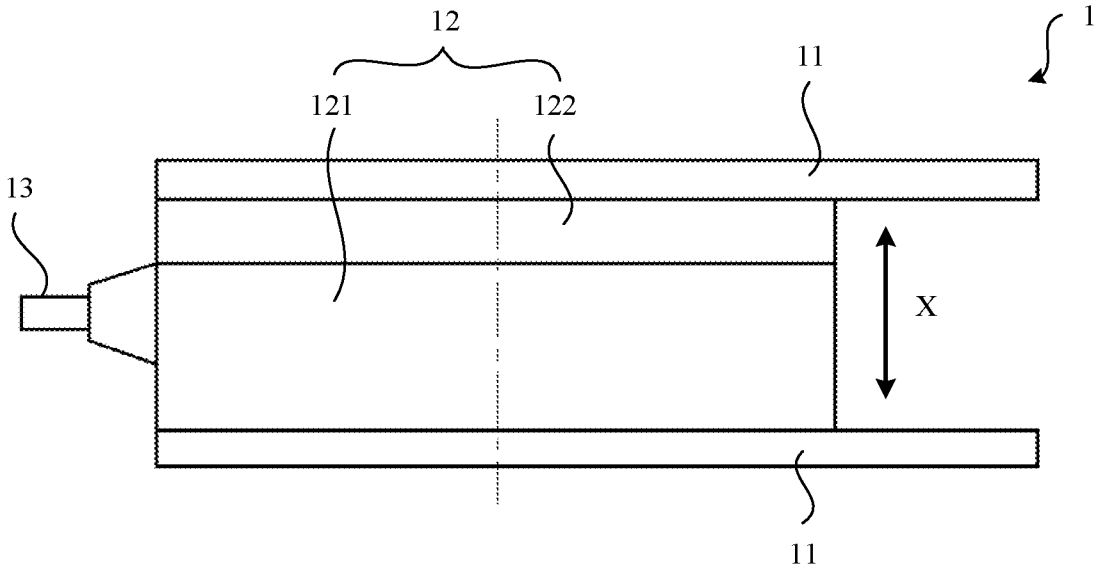
FIG. 4 is a main view of a second structure of a pillar-shaped luneberg lens antenna according to an embodiment of this application.

Optionally, as shown in FIG. 3 or FIG. 4, the distribution of the equivalent dielectric constants of the main layer 121 of the pillar-shaped luneberg lens in the TE10 mode is consistent with the distribution of the preset dielectric constants, and the compensation layer 122 is configured to negatively compensate for the equivalent dielectric constants of the main layer 121 of the pillar-shaped luneberg lens in the TEM mode, so that the distribution of the equivalent dielectric constants of the pillar-shaped luneberg lens 12 in the TEM mode is consistent with the distribution of the preset dielectric constants. In this way, the pillar-shaped luneberg lens antenna 1 provided in the embodiments of this application can implement both the vertical polarization and the horizontal polarization at the same time, thereby improving the capacity of the communications system. In addition, the compensation layer 122 only compensates for the equivalent dielectric constants of the main layer 121 of the pillar-shaped luneberg lens in the TEM mode. Therefore, a structure of the compensation layer 122 is simple and easy to implement.

In some embodiments, as shown in FIG. 3 or FIG. 4, the compensation layer 122 is a dielectric layer whose equivalent dielectric constants are less than a minimum equivalent dielectric constant of the main layer of the pillar-shaped luneberg lens, the compensation layer 122 and the main layer 121 of the pillar-shaped luneberg lens are stacked layer by layer, and the compensation layer 122 is located at at least one end of the pillar-shaped luneberg lens along an axis of the main layer 121 of the pillar-shaped luneberg lens. In this way, the compensation layer 122 can negatively compensate for the equivalent dielectric constants of the main layer 121 of the pillar-shaped luneberg lens in the TEM mode. In addition, the compensation layer 122 has slight effect on the equivalent dielectric constants of the main layer 121 of the pillar-shaped luneberg lens in the TE10 mode, and can only negatively compensate for the equivalent dielectric constants of the main layer 121 of the pillar-shaped luneberg lens in the TEM mode on the premise that the distribution of the equivalent dielectric constants of the main layer 121 of the pillar-shaped luneberg lens in the TE10 mode is consistent with the distribution of the preset dielectric constants, so that the distribution of the dielectric constants of the pillar-shaped luneberg lens 12 in the TEM mode is consistent with the distribution of the preset dielectric constants.

In the foregoing embodiment, the compensation layer 122 may be an air layer, a vacuum layer, a foam layer, a sponge layer, a puncturing medium layer, or the like. This is not specifically limited herein, provided that the equivalent dielectric constants of the compensation layer 122 are less than the minimum equivalent dielectric constant of the main layer of the pillar-shaped luneberg lens. In addition, the compensation layer 122 may be only an air layer, a foam layer, or a structure formed by arranging the air layer and the foam layer at intervals. This is not specifically limited herein. In some embodiments, as shown in FIG. 3 or FIG. 4, the compensation layer 122 is only an air layer. In some other embodiments, the compensation layer 122 is a structure formed by arranging the foam layer and the air layer at intervals.

There may be one compensation layer 122, and the one compensation layer 122 is located at one end of the main layer 121 of the pillar-shaped luneberg lens along the axis of the main layer 121 of the pillar-shaped luneberg lens. There may be two compensation layers 122, and the two compensation layers 122 are respectively located at two ends of the main layer 121 of the pillar-shaped luneberg lens along the axis of the main layer 121 of the pillar-shaped luneberg lens. This is not specifically limited herein. In some embodiments, as shown in FIG. 4, there is one compensation layer 122, and the one compensation layer 122 is located at one end of the main layer 121 of the pillar-shaped luneberg lens along the axis of the main layer 121 of the pillar-shaped luneberg lens. In some embodiments, as shown in FIG. 3, there are two compensation layers 122, and the two compensation layers 122 are located at two ends of the main layer 121 of the pillar-shaped luneberg lens along the axis of the main layer 121 of the pillar-shaped luneberg lens.

Figure 8:
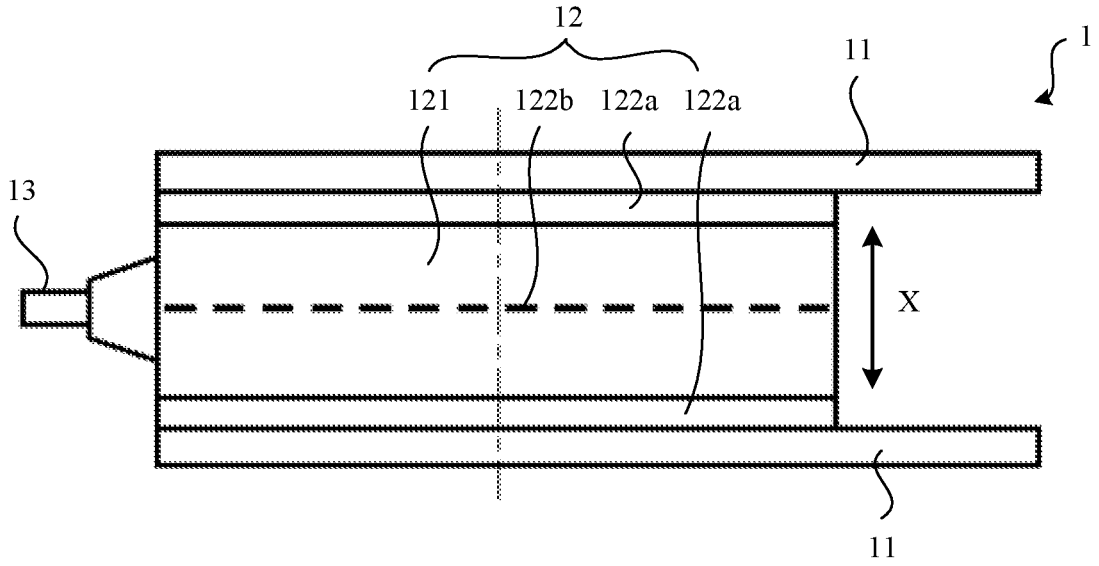
FIG. 8 is a main view of a sixth structure of a pillar-shaped luneberg lens antenna according to an embodiment of this application.
Figure 9:
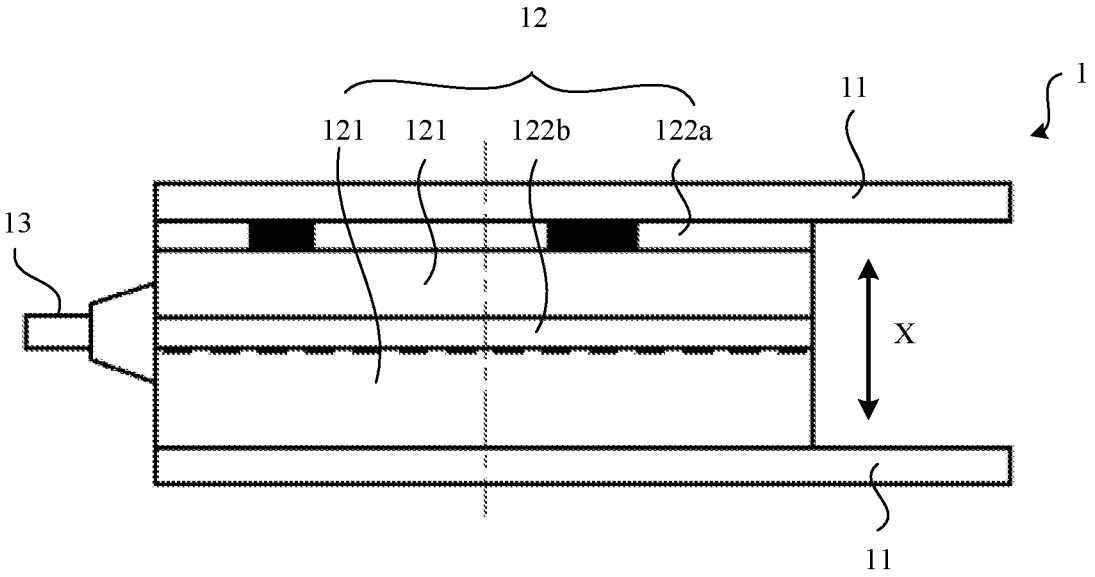
FIG. 9 is a main view of a seventh structure of a pillar-shaped luneberg lens antenna according to an embodiment of this application.

Optionally, as shown in FIG. 8 or FIG. 9, all equivalent dielectric constants of the main layer 121 of the pillar-shaped luneberg lens in the TEM mode along each radial position of the main layer 121 of the pillar-shaped luneberg lens are greater than dielectric constants at corresponding radii in the distribution of the preset dielectric constants. All equivalent dielectric constants of the main layer 121 of the pillar-shaped luneberg lens in the TE10 mode along each radial position of the main layer 121 of the pillar-shaped luneberg lens are less than dielectric constants at corresponding radii in the distribution of the preset dielectric constants. The compensation layer 122 is configured to negatively compensate for the equivalent dielectric constants of the main layer 121 of the pillar-shaped luneberg lens in the TEM mode, and positively compensate for the equivalent dielectric constants of the main layer 121 of the pillar-shaped luneberg lens in the TE10 mode. Therefore, the distribution of the equivalent dielectric constants of the pillar-shaped luneberg lens 12 in the TEM mode and in the TE10 mode are consistent with the distribution of the preset dielectric constants. In this way, the pillar-shaped luneberg lens antenna 1 provided in the embodiments of this application can implement both the vertical polarization and the horizontal polarization at the same time, thereby improving the capacity of the communications system.

Optionally, as shown in FIG. 8 or FIG. 9, the compensation layer 122 includes a first compensation layer 122*a* and a second compensation layer 122*b*. The first compensation layer 122*a* is configured to negatively compensate for the equivalent dielectric constants of the main layer 121 of the pillar-shaped luneberg lens in the TEM mode, so that the distribution of the equivalent dielectric constants of the pillar-shaped luneberg lens 12 in the TEM mode is consistent with the distribution of the preset dielectric constants. The second compensation layer 122*b* is configured to positively compensate for the equivalent dielectric constants of the main layer 121 of the pillar-shaped luneberg lens in the TE10 mode, so that the distribution of the equivalent dielectric constants of the pillar-shaped luneberg lens 12 in the TE10 mode is consistent with the distribution of the preset dielectric constants. In this way, the pillar-shaped luneberg lens antenna 1 provided in the embodiments of this application can implement both the vertical polarization and the horizontal polarization at the same time, thereby improving the capacity of the communications system.

Figure 10:
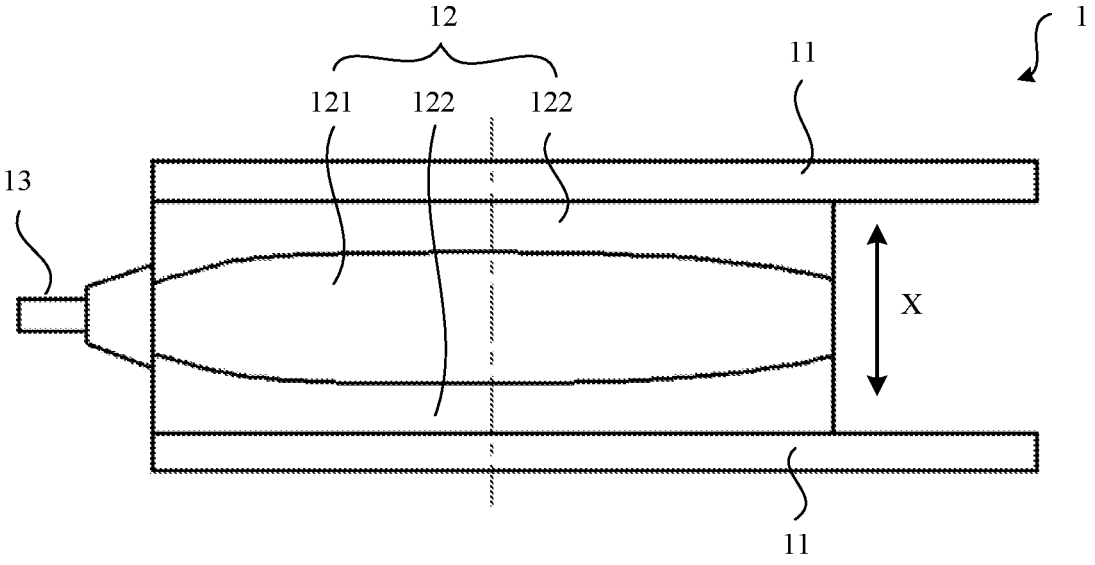
FIG. 10 is a main view of an eighth structure of a pillar-shaped luneberg lens antenna according to an embodiment of this application.
Figure 11:
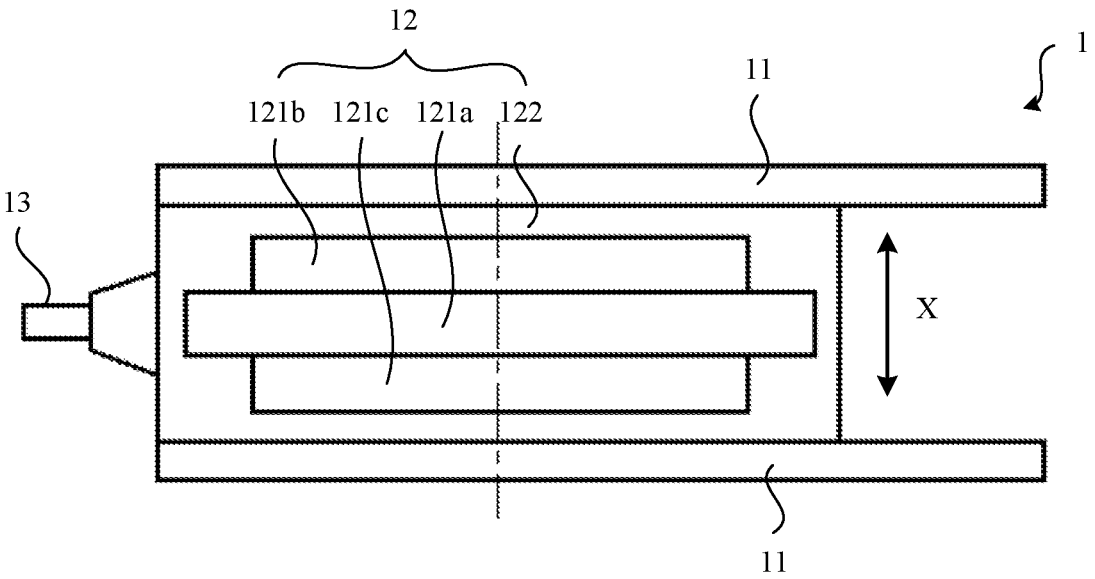
FIG. 11 is a main view of a ninth structure of a pillar-shaped luneberg lens antenna according to an embodiment of this application.

The main layer 121 of the pillar-shaped luneberg lens may be in a structure of a circular flat plate, in a shape that is similar to a convex lens and that has a thin edge and a thick middle part (as shown in FIG. 10), or in a structure stacked by a plurality of pillar-shaped luneberg lenses 121*a*, 121*b*, and 121*c* (as shown in FIG. 11). This is not specifically limited herein. In some embodiments, as shown in any one of FIG. 3 to FIG. 9, the main layer 121 of the pillar-shaped luneberg lens is in a structure of a circular flat plate. In this way, a thickness of each position on the main layer 121 of the pillar-shaped luneberg lens is uniform and consistent. This makes the pillar-shaped luneberg lens more easier to process.

When the main layer 121 of the pillar-shaped luneberg lens is in the structure of the circular flat plate, to fit the distribution of the dielectric constants of the main layer 121 of the pillar-shaped luneberg lens, the structure of the circular flat plate may be specifically the following structure.

Figure 12:
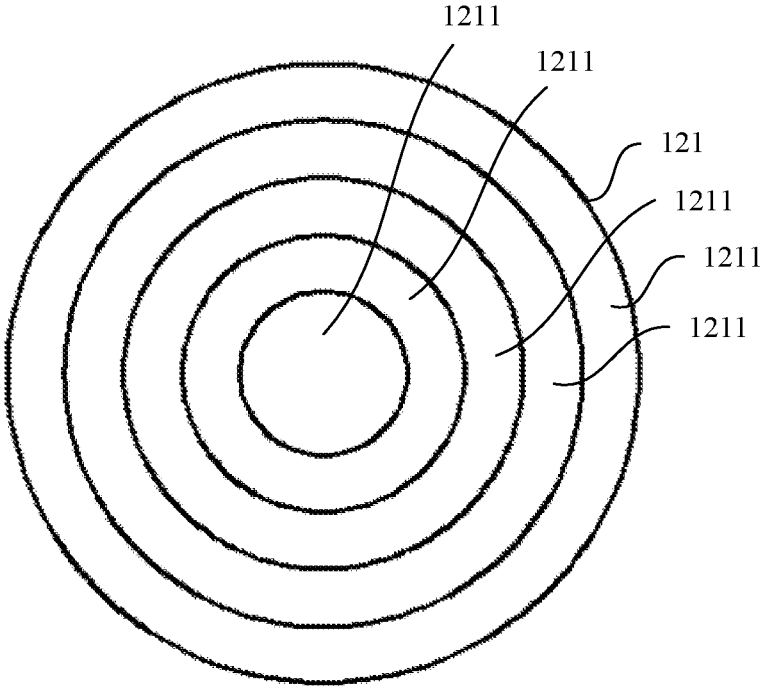
FIG. 12 is a top view of a first structure of a main layer of a pillar-shaped luneberg lens in a pillar-shaped luneberg lens antenna according to an embodiment of this application.

In some embodiments, as shown in FIG. 12, the main layer 121 of the pillar-shaped luneberg lens includes a plurality of annular dielectric layers 1211 that are successively disposed from inside to outside along a radial direction of the main layer 121 of the pillar-shaped luneberg lens, the plurality of annular dielectric layers 1211 are made of different materials, and dielectric constants of the materials of the plurality of annular dielectric layers 1211 gradually decrease from inside to outside along the radial direction of the main layer 121 of the pillar-shaped luneberg lens. In this way, different dielectric constants of the material are used, and the distribution of the dielectric constants of the main layer 121 of the pillar-shaped luneberg lens is simulated. This structure is simple and easy to implement.

In the foregoing embodiment, there may be three, five, or countless annular dielectric layers 1211. This is not specifically limited herein. In some embodiments, as shown in FIG. 12, there are five annular dielectric layers 1211. When there are countless annular dielectric layers 1211, the main layer 121 of the pillar-shaped luneberg lens may be manufactured by using a 3D printing technology.

Figure 13:
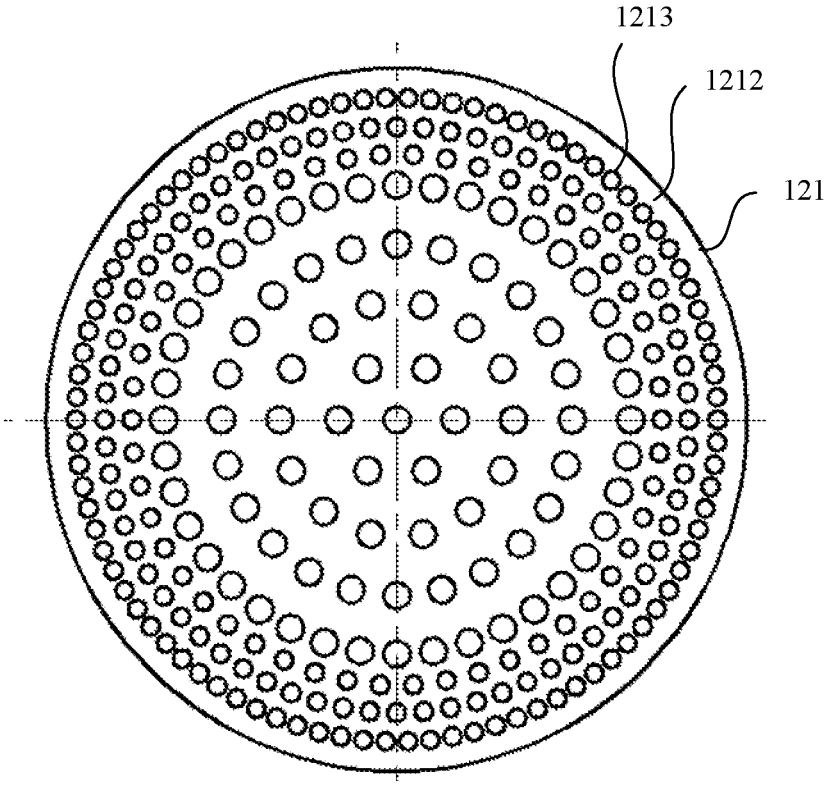
FIG. 13 is a top view of a second structure of a main layer of a pillar-shaped luneberg lens in a pillar-shaped luneberg lens antenna according to an embodiment of this application.

In some other embodiments, as shown in FIG. 13, the main layer 121 of the pillar-shaped luneberg lens includes a circular substrate 1212, a plurality of through holes 1213 are disposed on the substrate 1212, and a porosity rate of the substrate 1212 gradually increases from inside to outside along the radial direction of the main layer 121 of the pillar-shaped luneberg lens. In this way, the porosity rate with different values is used, the distribution of the dielectric constants of the main layer 121 of the pillar-shaped luneberg lens is simulated, and a plurality of materials do not need to be disposed. Therefore, the structure is simple, and the costs are relatively low. A porosity mode on the substrate 1212 may be equal-spacing variable-radius porosity, or equal-radius variable-spacing porosity. This is not specifically limited herein.

Optionally, as shown in any one of FIG. 3 to FIG. 11, the pillar-shaped luneberg lens antenna 1 further includes a dual-polarization feed 13 opposite to a side wall of the main layer 121 of the pillar-shaped luneberg lens. The dual-polarization feed 13 includes but is not limited to a dual-polarization microstrip patch, a dual-polarization plane Yagi antenna, a dual-polarization conical dielectric antenna, a dual-polarization open-end waveguide antenna, or a dual-polarization horn antenna.

In some embodiments, the pillar-shaped luneberg lens antenna 1 further includes a signal feeding apparatus (not shown in the figure). The signal feeding apparatus is connected to the dual-polarization feed 13. The signal feeding apparatus is configured to separately feed two signals whose phases differ by 90 degrees to two input ports of the dual-polarization feed 13, to implement circular polarization of the pillar-shaped luneberg lens antenna 1.

Figure 14:
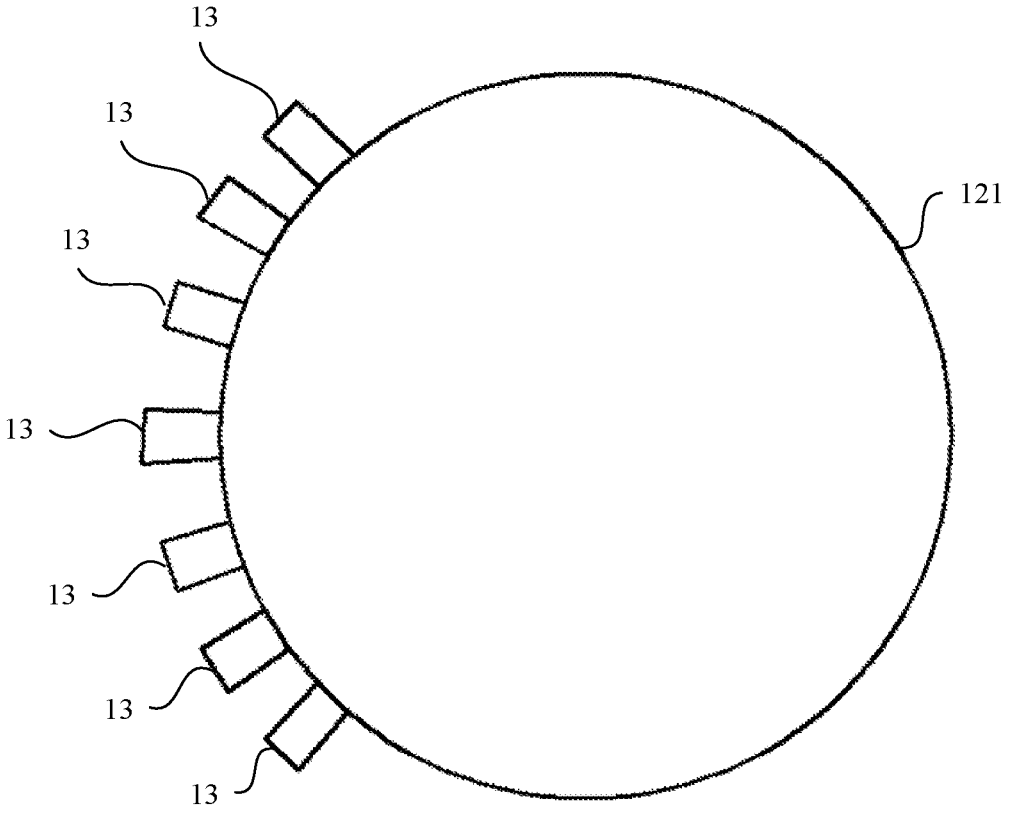
FIG. 14 is a top view of a tenth structure of a pillar-shaped luneberg lens antenna after a metal plate is removed according to an embodiment of this application.

Optionally, as shown in any one of FIG. 3 to FIG. 11, the pillar-shaped luneberg lens antenna 1 further includes a dual-polarization feed 13 opposite to a side wall of the main layer 121 of the pillar-shaped luneberg lens. As shown in FIG. 14, there are a plurality of dual-polarization feeds 13, and the plurality of dual-polarization feeds 13 are sequentially arranged along a circumferential direction of the main layer 121 of the pillar-shaped luneberg lens. In this way, a switch is switched to input signals to different dual-polarization feeds 13, and rotation scanning can be implemented in a plane parallel to the metal plate 11. In addition, signals can be input to the plurality of dual-polarization feeds 13 at the same time, so that a plurality of beams can work at the same time.

Figure 15:
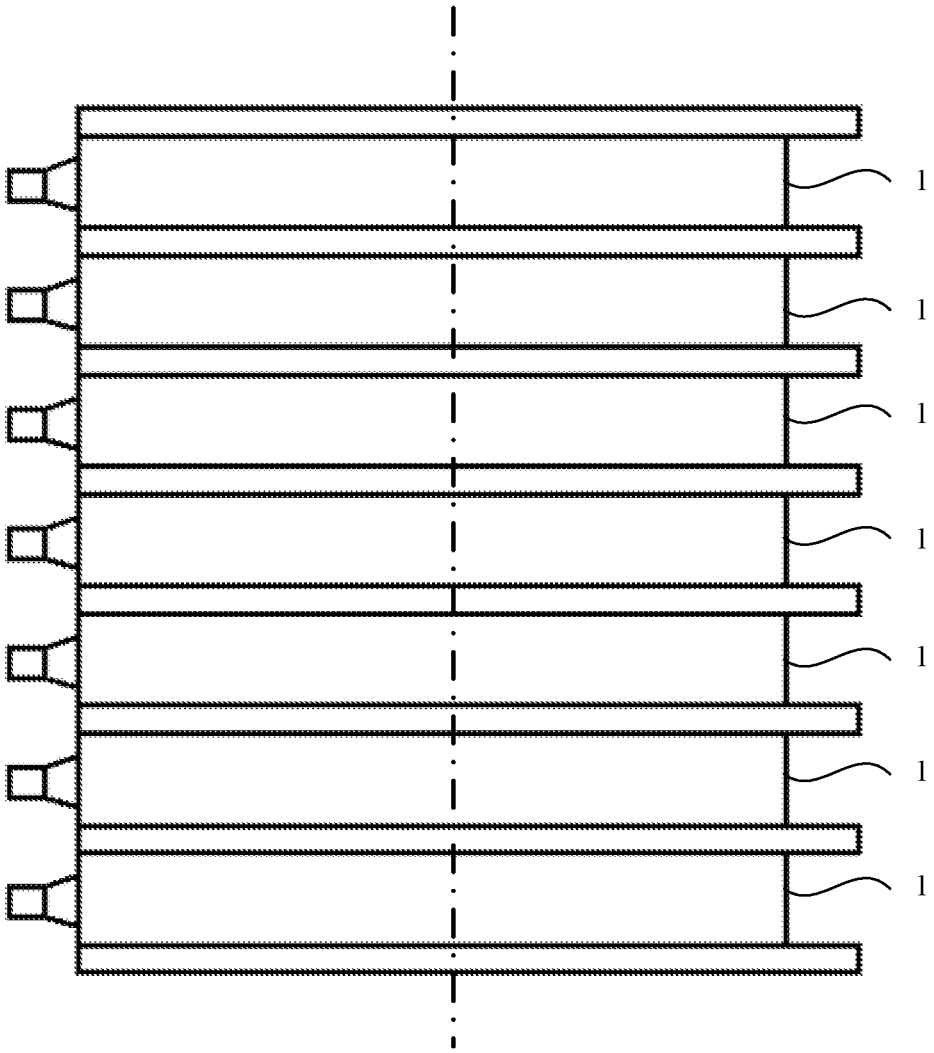
FIG. 15 is a schematic structural diagram of a pillar-shaped luneberg lens antenna array according to an embodiment of this application.

According to a second aspect, as shown in FIG. 15, some embodiments of this application provide a pillar-shaped luneberg lens antenna array, including a plurality of pillar-shaped luneberg lens antennas 1 according to any one of the foregoing technical solutions. The plurality of pillar-shaped luneberg lens antennas 1 are sequentially stacked along an extension direction of a central axis of a main layer of the pillar-shaped luneberg lens antenna 1.

Figure 2:
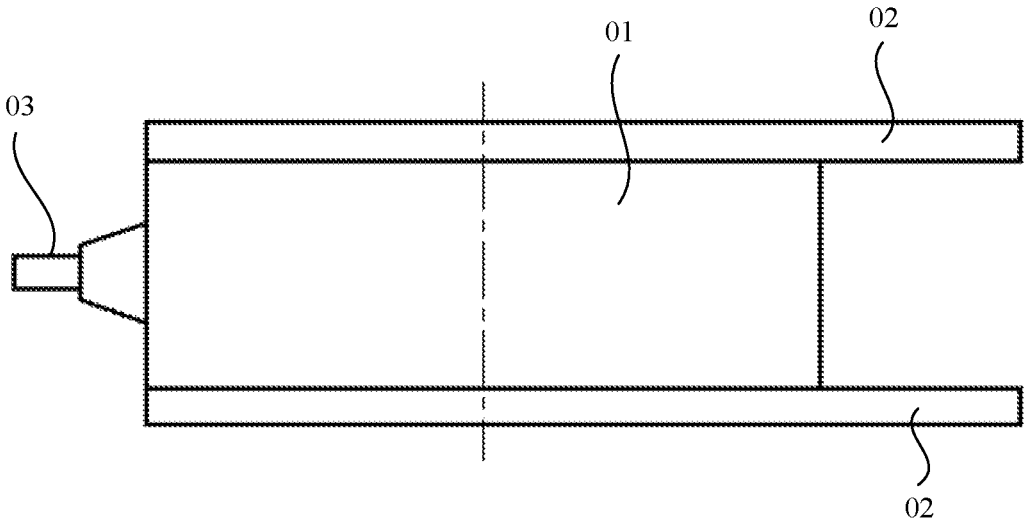
FIG. 2 is a main view of a pillar-shaped luneberg lens antenna in the conventional technology.

Compared with the conventional technology, the pillar-shaped luneberg lens antenna array provided in some embodiments of this application includes the plurality of pillar-shaped luneberg lens antennas 1 according to any one of the foregoing technical solutions. The pillar-shaped luneberg lens antenna 1 described in any one of the foregoing technical solutions can implement the polarization in both the vertical direction and the horizontal direction at the same time, and improve the capacity of the communications system. Therefore, the pillar-shaped luneberg lens antenna array provided in the embodiments of this application can implement the polarization in both the vertical direction and the horizontal direction, and improve the capacity of the communications system. In addition, compared with an antenna including the classic luneberg lens, the conventional pillar-shaped luneberg lens antenna shown in FIG. 2 loses a scanning capability in a direction vertical to a metal plate 02. Compared with the conventional pillar-shaped luneberg lens antenna shown in FIG. 2, the pillar-shaped luneberg lens antenna array provided in the embodiments of this application can input signals with different phases to the plurality of pillar-shaped luneberg lens antennas 1, to implement beam scanning in the plane vertical to the metal plate in the pillar-shaped luneberg lens antenna 1.

In the descriptions of this specification, the described specific features, structures, materials, or characteristics may be combined in a proper manner in any one or more of the embodiments or examples.

Finally, it should be noted that the foregoing embodiments are merely intended to describe the technical solutions of this application, but not to limit this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the spirit and scope of the technical solutions of the embodiments of this application.

What is claimed is:

1. A pillar-shaped luneberg lens antenna, comprising two metal plates parallel to each other and a pillar-shaped luneberg lens disposed between the two metal plates, wherein the pillar-shaped luneberg lens comprises a main layer and a compensation layer, and the compensation layer is configured to compensate for equivalent dielectric constants of the main layer of the pillar-shaped luneberg lens in a TEM mode and/or a TE10 mode, so that a distribution of the equivalent dielectric constants of the pillar-shaped luneberg lens in the TEM mode and the TE10 mode is consistent with a distribution of preset dielectric constants;

when the distribution of the equivalent dielectric constants of the pillar-shaped luneberg lens in the TEM mode is consistent with the distribution of the preset dielectric constants, the pillar-shaped luneberg lens antenna has a polarization in a direction orthogonal to the two metal plates; and when the distribution of the equivalent dielectric constants of the pillar-shaped luneberg lens in the TE10 mode is consistent with the distribution of the preset dielectric constants, the pillar-shaped luneberg lens antenna has a polarization in a direction parallel to the two metal plates.

2. The pillar-shaped luneberg lens antenna according to claim 1, wherein the distribution of the preset dielectric constants is a distribution of dielectric constants of a classic luneberg lens.

3. The pillar-shaped luneberg lens antenna according to claim 1, wherein the distribution of the equivalent dielectric constants of the main layer of the pillar-shaped luneberg lens in the TEM mode is consistent with the distribution of the preset dielectric constants, and the compensation layer is configured to positively compensate for the equivalent dielectric constants of the main layer of the pillar-shaped luneberg lens in the TE10 mode, so that the distribution of the equivalent dielectric constants of the pillar-shaped luneberg lens in the TE10 mode is consistent with the distribution of the preset dielectric constants.

4. The pillar-shaped luneberg lens antenna according to claim 3, wherein the compensation layer comprises a sheet-like substrate, the sheet-like substrate is parallel to the two metal plates, the sheet-like substrate comprises a first surface and a second surface that are opposite to each other, and a metal sheet array is pasted on the first surface and/or the second surface.

5. The pillar-shaped luneberg lens antenna according to claim 3, wherein the compensation layer comprises a plurality of metal sheets arranged in a same plane that is parallel to the two metal plates, and each metal sheet is parallel to the two metal plates.

6. The pillar-shaped luneberg lens antenna according to claim 3, wherein the compensation layer is disposed in a middle part of the main layer of the pillar-shaped luneberg lens along an axis of the main layer of the pillar-shaped luneberg lens.

7. The pillar-shaped luneberg lens antenna according to claim 1, wherein the distribution of the equivalent dielectric constants of the main layer of the pillar-shaped luneberg lens in the TE10 mode is consistent with the distribution of the preset dielectric constants, and the compensation layer is configured to negatively compensate for the equivalent dielectric constants of the main layer of the pillar-shaped luneberg lens in the TEM mode, so that the distribution of the equivalent dielectric constants of the pillar-shaped luneberg lens in the TEM mode is consistent with the distribution of the preset dielectric constants.

8. The pillar-shaped luneberg lens antenna according to claim 7, wherein the compensation layer is a dielectric layer having equivalent dielectric constants that are less than a minimum equivalent dielectric constant of the main layer of the pillar-shaped luneberg lens, the compensation layer and the main layer of the pillar-shaped luneberg lens are stacked layer by layer, and the compensation layer is located at at least one end of the pillar-shaped luneberg lens along an axis of the main layer of the pillar-shaped luneberg lens.

9. The pillar-shaped luneberg lens antenna according to claim 1, wherein all equivalent dielectric constants of the main layer of the pillar-shaped luneberg lens in the TEM mode along each radial position of the main layer of the pillar-shaped luneberg lens are greater than dielectric constants at corresponding radii in the distribution of the preset dielectric constants; all equivalent dielectric constants of the main layer of the pillar-shaped luneberg lens in the TE10 mode along each radial position of the main layer of the pillar-shaped luneberg lens are less than dielectric constants at corresponding radii in the distribution of the preset dielectric constants; and the compensation layer is configured to negatively compensate for the equivalent dielectric constants of the main layer of the pillar-shaped luneberg lens in the TEM mode, and positively compensate for the equivalent dielectric constants of the main layer of the pillar-shaped luneberg lens in the TE10 mode, so that the distribution of the equivalent dielectric constants of the pillar-shaped luneberg lens in the TEM mode and in the TE10 mode are consistent with the distribution of the preset dielectric constants.

10. The pillar-shaped luneberg lens antenna according to claim 9, wherein the compensation layer comprises a first compensation layer and a second compensation layer, the first compensation layer is configured to negatively compensate for the equivalent dielectric constants of the main layer of the pillar-shaped luneberg lens in the TEM mode, so that the distribution of the equivalent dielectric constants of the pillar-shaped luneberg lens in the TEM mode is consistent with the distribution of the preset dielectric constants; and the second compensation layer is configured to positively compensate for the equivalent dielectric constants of the main layer of the pillar-shaped luneberg lens in the TE10 mode, so that the distribution of the equivalent dielectric constants of the pillar-shaped luneberg lens in the TE10 mode is consistent with the distribution of the preset dielectric constants.

11. The pillar-shaped luneberg lens antenna according to claim 1, wherein the main layer of the pillar-shaped luneberg lens is in a shape of a circular flat plate.

12. The pillar-shaped luneberg lens antenna according to claim 11, wherein the main layer of the pillar-shaped luneberg lens comprises a plurality of annular dielectric layers that are successively disposed from inside to outside along a radial direction of the main layer of the pillar-shaped luneberg lens, the plurality of annular dielectric layers are made of different materials, and dielectric constants of the materials of the plurality of annular dielectric layers gradually decrease from inside to outside along the radial direction of the main layer of the pillar-shaped luneberg lens.

13. The pillar-shaped luneberg lens antenna according to claim 11, wherein the main layer of the pillar-shaped luneberg lens comprises a circular substrate, a plurality of through holes are disposed on the substrate, and a porosity rate of the substrate gradually increases from inside to outside along the radial direction of the main layer of the pillar-shaped luneberg lens.

14. A pillar-shaped luneberg lens antenna array, comprising a plurality of pillar-shaped luneberg lens antennas according to claim 1, wherein the plurality of pillar-shaped luneberg lens antennas are sequentially stacked along an extension direction of a central axis of the main layer of each pillar-shaped luneberg lens antenna.

* * * * *